United States Patent [19]

Thompson

[11] Patent Number: 4,628,614

[45] Date of Patent: Dec. 16, 1986

[54] FLIGHTING FOR HORIZONTAL DRYERS

[76] Inventor: Stanley P. Thompson, 700 W. Laurent, Topeka, Kans. 66608

[21] Appl. No.: 745,683

[22] Filed: Jul. 17, 1985

Related U.S. Application Data

[62] Division of Ser. No. 535,572, Sep. 26, 1983, Pat. No. 4,549,699.

[51] Int. Cl.[4] ..... B02C 17/10

[52] U.S. Cl. ..... 34/12; 34/19; 34/135; 34/141; 34/142; 241/91; 241/299

[58] Field of Search ..... 34/108, 130, 135, 136, 34/137, 126, 141, 142, 229, 316, 12, 19; 241/245, 284, 188 R, 248, 176, 177, 182, 183, 299, 91, 92

[56] References Cited

U.S. PATENT DOCUMENTS

| | | | |
|---|---|---|---|
| 3,407,511 | 10/1968 | Camm | 34/109 |
| 3,503,790 | 3/1970 | Gringras | 34/57 A |
| 3,861,055 | 1/1975 | Thompson | 34/10 |

*Primary Examiner*—Larry I. Schwartz

*Attorney, Agent, or Firm*—Kokjer, Kircher, Bradley, Wharton, Bowman & Johnson

[57] ABSTRACT

An improved flighting for dryers is the subject of the present invention. An elongated drying drum is disposed for rotation about its longitudinal axis. The inner surface of the drum is provided with a plurality of material distributing vanes in circumferentially spaced relationship. The vanes are characterized by first surface extending generally transverse to a tangent to set body at the point of attachment and a second wedge-shaped surface intersecting the first surface. The wedge-shaped surface may also be provided with a lip extending circumferentially therefrom. A plurality of interference structures are disposed from a central longitudinal support and provide means for distributing material gravitating from the outer peripheral vanes. A plurality of return flighting members are disposed along the inner surface of the drum between the afore described material distributing vanes. These flighting members are disposed at an angle and conform generally to the curvature of the inner surface. A method of drying a product includes passing the product through a dryer, rotating the dryer, and comminuting the product while it is being dried.

8 Claims, 11 Drawing Figures

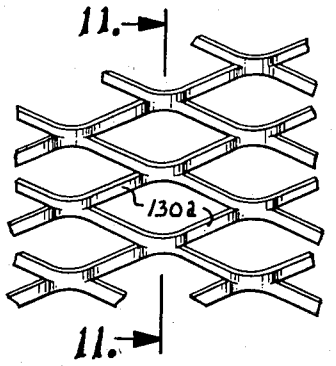
Fig. 10.
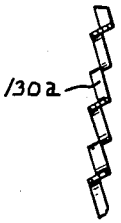
Fig. 11.
Fig. 8.
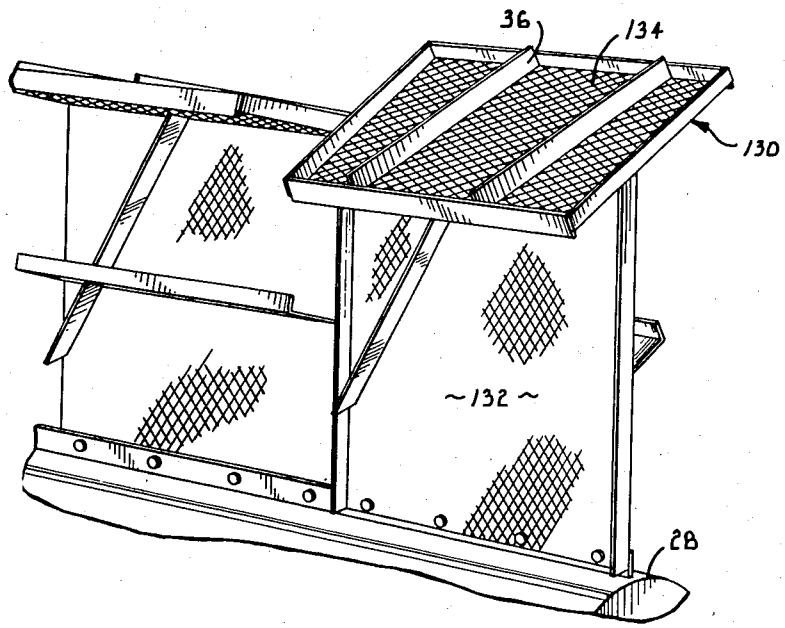
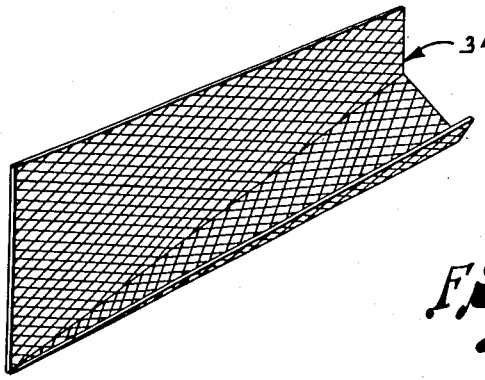
Fig. 9.

FLIGHTING FOR HORIZONTAL DRYERS

This is a division of application Ser. No. 535,572, filed Sept. 26, 1983 now U.S. Pat. No. 4,549,699.

This invention relates generally to hot air dryers and, more particularly, to a dryer having improved flighting for handling bulk solid material.

Various types of flighting arrangements for dehydrators are shown in my prior patents, U.S. Pat. Nos. 3,717,937; 3,798,789; and 3,861,055. In each of the prior patents, peripheral vanes are disposed around the circumference of a rotating drum so as to distribute material throughout the cross-sectional area as the drum rotates. In the case of the latter two patents, so-called "return flighting" is employed radially spaced from the peripheral vanes so as to help direct material back toward the drum inlet against the flow of air through the drum. While this technique and equipment have been found to be highly effective and represent a significant advance in the art, further improved results are possible with the equipment of the present invention.

With the construction shown in the prior patents referenced above, material being dried is picked up by the peripheral vanes, moved partially around the circumference of the drum, and is then dropped off under gravitational forces. A study of the cross-sectional area of a dehydrating drum as material is being dried has revealed that the material gravitating from the peripheral vanes tends to drop in "globs" or "bunches" leaving voids where little or no material is present in the cross-sectional area. Thus, the heat which is present at the location of these voids is not being effectively utilized and the relatively large masses of material which are present in other areas are unable to use the heat within their vicinity in the most efficient manner.

It is, therefore, a primary object of the present invention to increase the quantity of material being dried that is present in any given cross-sectional area of a rotary drum dryer thereby utilizing such area to the maximum possible extent.

As a corollary to the above object, it is an important objective to more evenly distribute material throughout any given cross-sectional area of a rotary dryer thereby reducing "voids" while also reducing large masses of material.

Another important objective of this invention is to provide apparatus which will achieve more efficient drying in a rotary drying drum by distributing the material being dried in a physical form throughout the drum that is congruous with the heat medium employed.

An important one of the aims of my invention is to provide a rotary drying drum where the holding time of the material being dried is increased for a given length of dryer, thereby, increasing the drying efficiency and allowing the drum to be shortened, or alternatively, a greater volume of material to be passed through a drum of given length.

It is also a very important objective of this invention to provide a rotary horizontal drying drum which incorporates the advantages of flash dryers and fluidized beds through utilization of a novel flighting arrangement while still maintaining the lower energy requirements, convenience, and other advantages of a rotary dryer.

Another one of the aims of this invention is to provide a rotary horizontal dryer having return flighting on the perimeter of the drum along the inner surface.

Another object of the invention is to provide a method and apparatus for drying a product wherein the product is comminuted while it passed through the dryer.

Other objects and advantages of the invention will be made clear or become apparent from the following description and claims when read in light of the accompanying drawing wherein:

FIG. 8 is a perspective view of a modified form of the invention;

FIG. 9 is a perspective view of a modified form of peripheral flight;

FIG. 10 is an enlarged fragmentary elevational view of the material used to construct the embodiments of FIGS. 8 & 9; and FIG. 11 is a vertical cross-sectional view taken along line 11—11 of FIG. 10.

Figure 1:
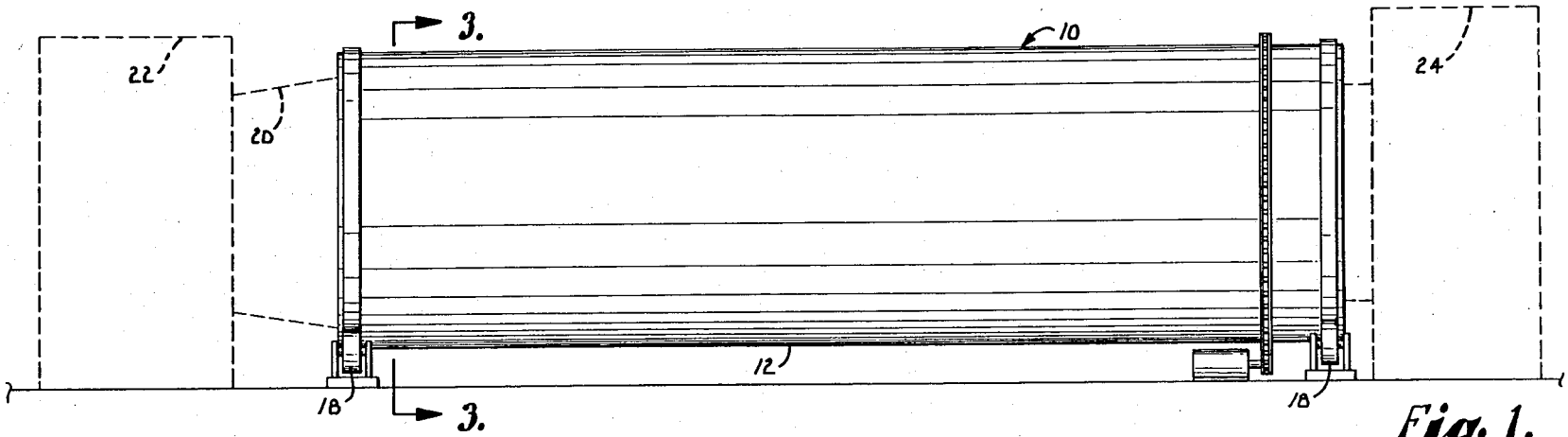
FIG. 1 is a side elevational view of a rotary dryer according to the present invention.

Referring initially to FIG. 1 of the drawing, a dryer according to the present invention is designated generally by the numeral 10 and comprises an elongated cylindrical drum 12 having a material inlet 14 and a material outlet 16. The drum is disposed horizontally relative to its longitudinal axis and is rotated on trunnion wheels 18. The inlet 14 of the dryer is coupled with an inlet cone indicated schematically by the numeral 20 and a forced air fan indicated schematically at 22. In some instances it may be desirable to have a draft fan coupled with the dryer at the opposite end from fan 22. The dryer 10 may be designed to operate completely on waste heat, or on a direct or indirect fired heat source (not shown) or a combination of the foregoing. Recycled gases may also be employed to enhance the efficiency of the primary heat source. At the outlet end 16, a settling chamber (or elbow) indicated schematically at 24 is provided. An outfeed screw (not shown) will normally be coupled with this chamber to remove dried material from the area.

Figure 4:
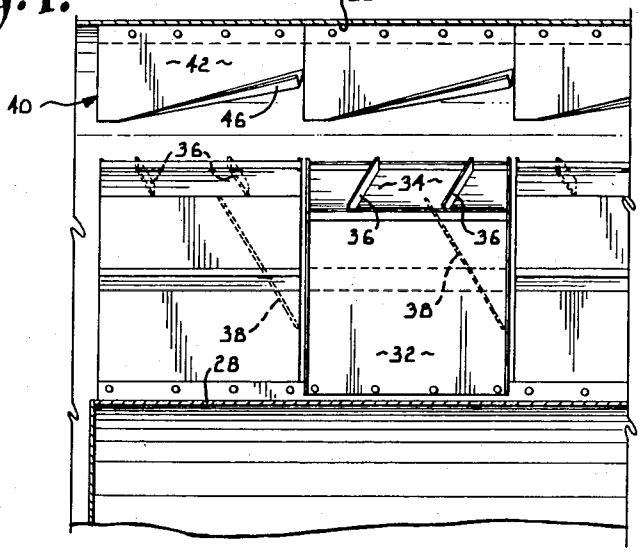
FIG. 4 is a vertical cross-sectional view taken along line 4—4 of FIG. 3.

Drum 12 is of circular vertical cross section and has a smooth continuous inside surface 26. A central tubular support 28 is mounted concentric with the longitudinal axis of drum 12 by a plurality of hanger supports (not shown) extending from the tubular member outwardly to surface 26. Mounted in equal spaced relationship around support 28 and extending radially therefrom is a plurality of interference structures 30. These interference structures are all substantially identical although in moving from one end of the drum to the other the structures 30 are alternately disposed in first one direction and then the other. Referring to FIG. 4, each interference structure comprises a stem plate 32 which extends radially from and is rigid with tubular support 28 and a cross plate 34 attached to plate 32 at the top thereof and intersecting the plane of plate 32. Cross plate 34 intersects the plane of plate 32 at an acute angle on one side and a supplemental angle on the opposite side. Projecting from the plane of cross plate 34 are return flights 36. Another return flight 38 is angularly disposed on the side of plate 32 opposite the side visible in FIG. 4.

Figure 5:
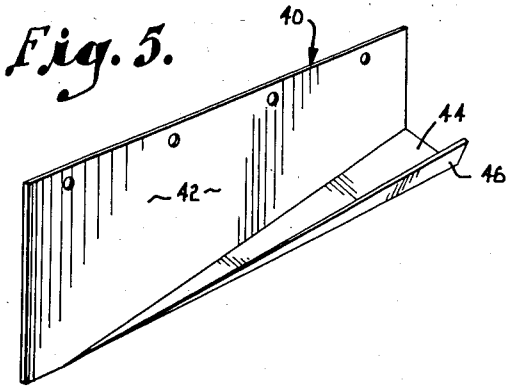
FIG. 5 is a perspective view of one of the peripheral vanes.

Disposed in circumferentially spaced relationship around inside surface 26 are a plurality of bars 39 which extend substantially the length of drum 12 and are rigid with the inside surface. These bars mount a plurality of relatively short material distributing vanes designated generally by the numeral 40. One of the vanes 40 is shown in FIG. 5. Each vane 40 is from about one half foot to eight feet in length and extends less than one fourth of the distance from the inside surface to the center of the drum. Each vane includes a first planar surface 42 that extends generally perpendicular to a tangent to the drum body at a point opposite the point of attachment of the vane. This first surface merges into a second wedge-shaped surface 44 that extends from the plane of the first surface at an angle of between about 90° to 150°. Surface 44 intersects the plane of surface 42 at a point spaced from the edge of the latter surface. Projecting upwardly from wedge-shaped surface 44 is a wedge-shaped lip 46. Manifestly, lip 46 tapers off toward the narrow end of surface 44.

Figure 3:
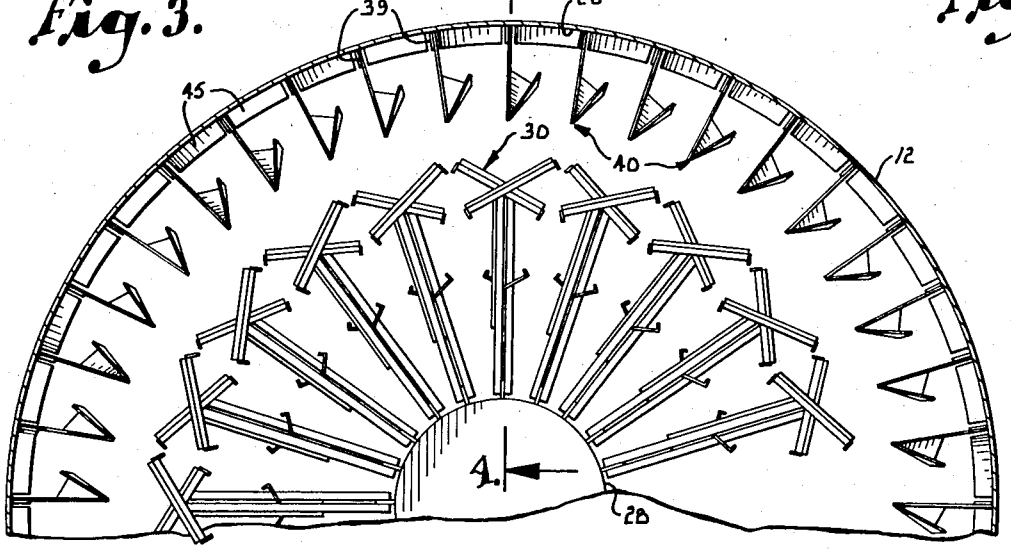
FIG. 3 is a vertical cross-sectional view taken in the direction of line 3—3 of FIG. 1.

Vanes 40 are rigidly secured to bars 39 and surface 44 is thereby disposed at an angle of less than 60° relative to the longitudinal axis of drum 12 (see FIG. 4). It will also be noted from viewing FIG. 3 that the leading edge of surface 44, from which lip 46 extends, is disposed at an acute angle relative to a vertical longitudinal section line passing through surface 42.

Figure 2:
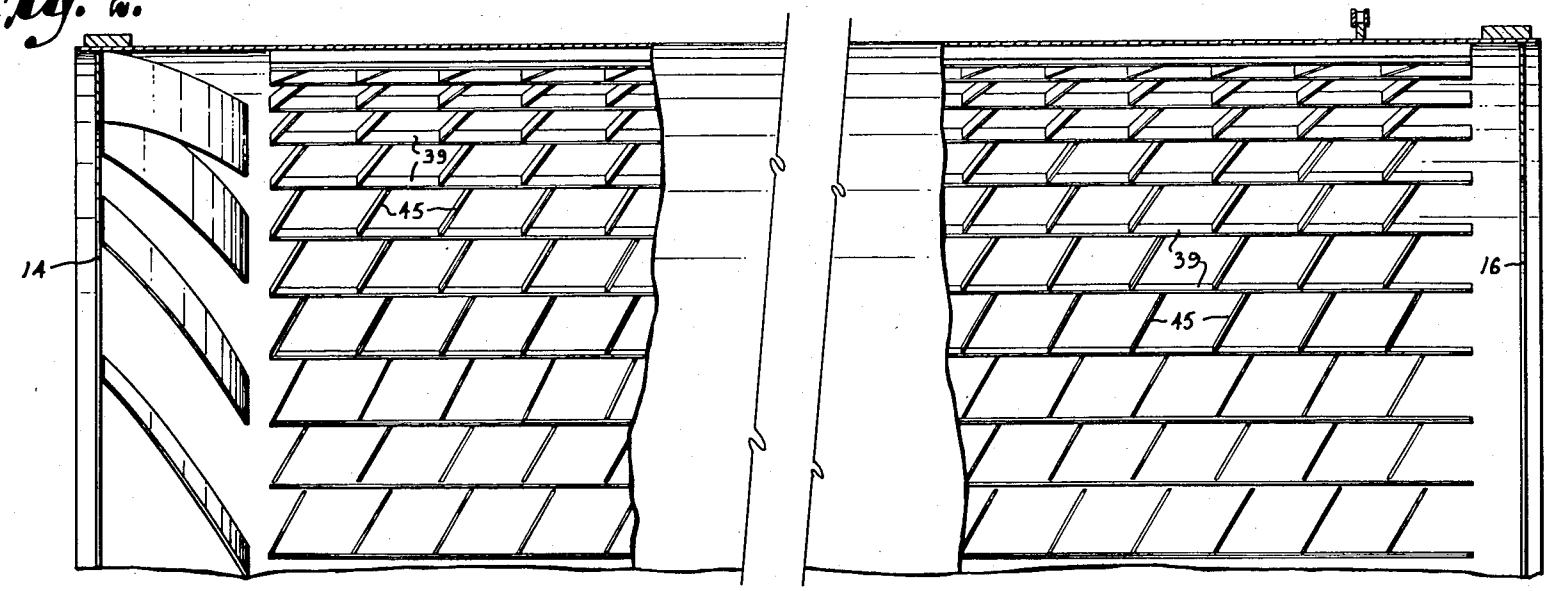
FIG. 2 is a longitudinal, vertical cross-sectional view of the dryer of FIG. 1.

Referring now to FIG. 2, vanes 40 and interference structures 30 have been omitted in order to better illustrate the arrangement of flighting members 46. Disposed between adjacent bars 39 are a plurality of flighting members 46. Flighting members 46 project from inside surface 26 and generally conform to the curvature of this surface. Each flighting member 46 is disposed at an angle relative to an imaginary vertical cross-sectional plane through the drum body, which angle is between about 30°–75° and preferably about 45°.

In operation, the dryer of the present invention may be utilized for drying virtually any solid material. The material is fed into the dryer and will be picked up by vanes 40 as drum 12 rotates. The material falling onto surfaces 44 will gravitate from these surfaces with the material located at the narrow end of the surface 44 falling ahead of material at the opposite end of the same surface. This enhances the "dribbling" effect of the these vanes and results in a more even flow of material throughout any given cross-sectional volume of the drum. The material will gravitate onto interference structures 30 where it is further held and dried before being dropped back onto subsequent vanes 40. Any material falling between vanes 40 will be acted upon by return flighting members 46 which will tend to cause the material to move back toward the direction of inlet 14. This of course increases the retention time of the material in the dryer improving drying efficiency. It has been found that return flights 46 disposed between vanes 40 cooperate well with the latter vanes to provide greatly enhanced efficiency of the overall drying operation.

Figure 7:
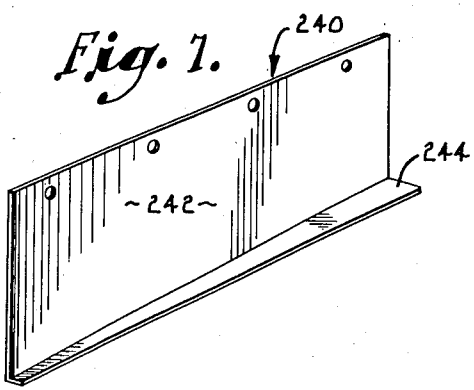
FIG. 7 is a perspective view of another alternative form of the invention.
Figure 6:
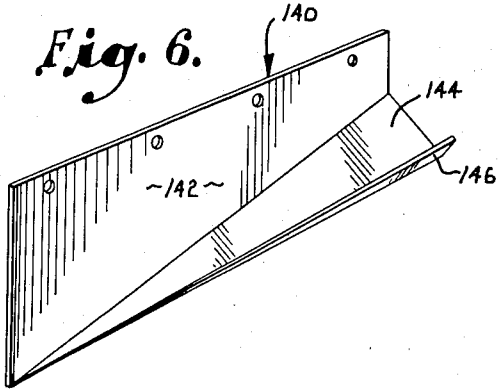
FIG. 6 is a perspective view similar to FIG. 5 of an alternative form of the invention.

Alternative embodiments of vanes 40 are illustrated in FIGS. 6 and 7 and designated respectively by the numerals 140 and 240. Vane 140 has a first surface 142 and a second surface 144 which intersects the first surface at an angle of approximately 120° as compared with an angle of 90° which surface 44 presents with surface 42 in the preferred embodiment. Lip 146 extends from wedge-shaped surface 144. With vane 240 shown in FIG. 7, wedge-shaped surface 244 extends along the entire leading edge of surface 242 and tapers somewhat more gradually than surface 44 of the preferred embodiment. Also, with vane 240 there is no lip projecting from the wedge-shaped surface 244. These alternative forms of the invention will find use with some types of materials which are to be dried.

Another alternative construction of vanes 40, which is not shown, would be for surface 44 to be of a generally rectangular configuration rather than wedge shaped as illustrated in FIG. 5. The surface would still extend from surface 44 at an angle of 90° and 150°.

Another alternative form of the invention is illustrated in FIG. 8. This figure shows interference structures 30 constructed of expanded metal and designated by the numeral 130. Expanded metal is a well known product and is defined by industry standards as being sheet metal which has been slit and expanded up to ten times its original width. The result is a product having a diamond shaped pattern as indicated in FIG. 10. The formation of the diamond shaped pattern adds to the strength and rigidity of the material but more importantly strands **130*a* provide sharp cutting surfaces which serve to comminute material gravitating onto the structures 130**.

Referring now to the structure 130 in greater detail, a stem plate 132 of expanded metal extends radially from and is rigid with tubular support 28 and a crossplate 134 attached to plate 132 at the top thereof, intersects the plane of the stem plate. Preferably, the angle of intersection between plates 132 and 134 is at an acute angle on one side and a supplemental angle on the opposite side. Projecting from the plane of cross plate 134 are return flights 36 as previously described in conjunction with interference structures 30.

In some instances it may also be desirable to construct peripheral vanes 40 of expanded metal and such a vane is illustrated in FIG. 9 and designated by the numeral 340. It is to be understood that any of the configuration for peripheral vanes as shown in FIGS. 5–7 and previously described can be employed with the vane 340 form of expanded metal. FIG. 11 illustrates the sharp cutting edges presented by expanded metal strands **130*a* in the construction of the embodiments of FIGS. 8 and 9. Referring to FIG. 10** of the drawing, the diamond pattern may be oriented so that its longest dimension is either parallel or perpendicular to the direction of flow of material. With any type of fibrous material this orientation should be perpendicular to the flow.

When utilizing the vanes and interference structures of expanded metal as aforedescribed it will be appreciated that the invention contemplates a method of drying a product wherein the product is passed through the drum, the drum is rotated about its longitudinal axis, and the material is carried partially around the perimeter of the drum and is then allowed to gravitate from the perimeter onto the comminuting surface 134 of interference structures 130. If the peripheral vanes are also constructed of expanded metal further comminuting will occur as material drops back onto these vanes.

By utilizing a dryer constructed according to the present invention, it has been found that solid materials can be placed in a geometrical form that is generally congruent with the gaseous media that is utilized to effect drying. Furthermore, the dryer of the present invention greatly facilitates even distribution of material throughout the cross-sectional area and maximizes the number of "particles" in any given area while greatly reducing the "voids." The result is greatly increased drying efficiency which can be utilized to reduce the overall length of the dryer or in the case of existing drums of a given length, increase the volume of material which can be placed through the drum in a given amount of time.

The construction of a drying drum according to the present invention results in heavy foreign objects being held at the inlet end of the drying drum rather than passing through it. In many cases, the heavy foreign objects will actually bounce from the inlet as the drum rotates. In effect, the drying drum of the invention will classify the material between foreigns and what is desired to be dried so that the latter will pass through the drum while the former is either retained at the front end or is actually pushed back out the inlet as the drum rotates.

It is believed that the present invention is the first time a comminuter has been specifically incorporated into a drying drum. The result is that any large particle materials which tend to "ball-up" can be ground into finer particles which will be dried much more effectively and efficiently. Another result is a greater concentration of "fines" in the dried product which burn more readily in a wider range of burners.

I claim:

1. A drying drum coupled with a heat source and means for rotating the drum about its longitudinal axis, said drum being adapted for drying a material which is subject to being comminuted, said drum comprising:

an elongated hollow body disposed with its longitudinal axis in a generally horizontal plane and characterized by an inner surface of generally circular vertical cross section and having a material inlet and material outlet;

a plurality of material distributing vanes coupled with the body and spaced circumferentially around around and longitudinally along said surface, at least some of said vanes being formed from expanded metal;

a plurality of circumferentially spaced interference structures coupled with said drum at a location spaced radially inward from said material distributing vanes and spaced longitudinally along the length of the drum;

said interference structure being formed from means for presenting a plurality of sharp cutting surfaces whereby when said material gravitates onto said structure it is comminuted by striking said surfaces.

2. The invention of claim 1, wherein said means for presenting said sharp cutting surfaces is disposed at a nonperpendicular angle relative to a plane passing through said longitudinal axis.

3. The invention of claim 2, wherein said means for presenting said sharp cutting surfaces comprise expanded metal.

4. The invention of claim 2, wherein said interference structures extend substantially the entire length of said drum.

5. A method of drying a product which is subject to being comminuted in an elongated horizontally disposed drying drum, said method comprising:

passing said product through the drum;

rotating the drum about its longitudinal axis as the product passes through; and subjecting said product to comminuting action as the product moves from the periphery of the drum toward said axis under gravitational forces and the drum rotates, said subjecting step including dropping said product onto an expanded metal surface which is disposed at a nonperpendicular angle relative to a plane passing through the longitudinal axis of said drum.

6. A method as set forth in claim 5, wherein said passing step comprises pneumatically conveying the product and wherein is included the steps of picking up said product, carrying said product partially around the perimeter of the drum and allowing said product to gravitate from the perimeter onto a plurality of cutting surfaces.

7. A drying drum coupled with a heat source and means for rotating the drum about its longitudinal axis, said drum comprising:

an elongated hollow body characterized by an inner surface of generally circular vertical cross section and having a material inlet and a material outlet;

a plurality of material distributing vanes coupled with the body and spaced circumferentially around and longitudinally along said surface;

at least some of said vanes being formed from expanded metal presenting a plurality of sharp cutting surfaces whereby when said material gravitates onto said vanes it is comminuted by striking said surfaces; and a plurality of circumferentially spaced interference structure coupled with said drum at a location spaced radially inward from said material distributing vanes and spaced longitudinally along the length of the drum.

8. A drying drum coupled with a heat source and means for rotating the drum about its longitudinal axis, said drum being adapted for drying a material which is subject to being comminuted, said drum comprising:

an elongated hollow body disposed with its longitudinal axis in a generally horizontal plane and characterized by an inner surface of generally circular vertical cross section and having a material inlet and material outlet;

a plurality of material distributing vanes coupled with the body and spaced circumferentially around and longitudinally along said surface;

a plurality of circumferentially spaced interference structures coupled with said drum at a location spaced radially inward from said material distributing vanes and spaced longitudinally along the length of the drum;

said interference structure being formed from expanded metal presenting a plurality of sharp cutting surfaces whereby when said material gravitates onto said structure it is comminuted by striking said surfaces.

* * * * *